US005927061A

United States Patent [19]

Greis

[11] Patent Number: 5,927,061

[45] Date of Patent: Jul. 27, 1999

[54] PROCESS AND DEVICE TO PIECE A YARN ON AN OPEN-END SPINNING DEVICE

[75] Inventor: Dietmar Greis, Ingolstadt, Germany

[73] Assignee: Rieter Ingolstadt Spinnereimaschinenbau AG, Ingolstadt, Germany

[21] Appl. No.: 08/909,585

[22] Filed: Aug. 12, 1997

[30] Foreign Application Priority Data

Aug. 24, 1996 [DE] Germany ..... 196 34 300

[51] Int. Cl.[6] ..... D01H 13/26

[52] U.S. Cl. ..... 57/263; 57/261

[58] Field of Search ..... 57/261, 263, 301

[56] References Cited

U.S. PATENT DOCUMENTS

| | | | |
|---|---|---|---|
| 3,911,658 | 10/1975 | Smith | 57/263 |
| 3,962,855 | 6/1976 | Stahlecker | 57/263 |
| 4,295,330 | 10/1981 | Pfeifer | 57/263 |
| 4,628,684 | 12/1986 | Morita et al. | 57/263 |
| 4,644,742 | 2/1987 | Lovas et al. . | |
| 4,653,261 | 3/1987 | Scheiber et al. | 57/263 |
| 5,022,222 | 6/1991 | Rupert et al. | 57/263 |
| 5,303,538 | 4/1994 | Pagura et al. | 57/263 |
| 5,778,651 | 7/1998 | Spindler et al. | 57/263 |

FOREIGN PATENT DOCUMENTS

| | | |
|---|---|---|
| 3417331A1 | 11/1984 | Germany . |
| 3516120A1 | 11/1986 | Germany . |

OTHER PUBLICATIONS

EPO Search Report Dated Jan. 5, 1998.
German Search Report, Dec. 11, 1996.

*Primary Examiner*—William Stryjewski
*Attorney, Agent, or Firm*—Dority & Manning

[57] ABSTRACT

The present invention relates to a process to piece a yarn (2) to an open-end spinning device (1), in which a plurality of handling devices (4) on a service unit (3) traveling alongside a plurality of identical open-end spinning devices (1) execute different work motions and in which a yarn end is taken over by a presentation device (31) and is conveyed to the open-end spinning device (1), and is then returned into same for piecing. In this process all the handling devices (4) go through a joint motion phase and if necessary through an individual motion phase. To carry out this process the handling devices (4) are mounted on a common bearing device (5) which can be moved back and forth between at least two work positions (I, II) by means of a drive arrangement (50) controlled by the control device (6).

12 Claims, 7 Drawing Sheets

PROCESS AND DEVICE TO PIECE A YARN ON AN OPEN-END SPINNING DEVICE

BACKGROUND OF THE INVENTION

The present invention relates to a process to piece a yarn in an open-end spinning device, as well as to a device to carry out this process.

According to a known process, the handling elements used for piecing carry out different operational movements on a traveling service unit servicing a plurality of open-end spinning devices placed next to each other in order to take the yarn from a presenting device and to take it back to the open-end spinning device concerned (DE 35 16 120 A1). The different handling elements have to travel sometimes relatively long paths for which they need much room. In addition it has been shown that, as a rule, it is not sufficient to move the handling elements only so far that they can carry out their specialized task. Instead, these handling elements must travel additional distances so that they can be placed in a rest position in which they do not hinder each other in their operation, and in addition making it possible for the service unit to continue traveling after completed piecing in that they either do not extend at all or at most by no more than a predetermined distance beyond the outer contours of the service unit. In this manner, the traveling unit becomes extremely complex and is therefore expensive and furthermore is difficult to maintain.

OBJECTS AND SUMMARY OF THE INVENTION

It is therefore an object of the present invention to create a process and a device which allow for short distances to be covered by the handling elements and a more compact and maintenance-friendly design of the service unit. Additional objects and advantages of the invention will be set forth in part in the following description, or may be obvious from the description, or may be learned through practice of the invention.

The objects are attained according to the presently claimed invention. In this manner all handling elements are moved together in one movement phase, so that for this movement no individual space is required. The individual movement distances which are required for most handling elements in addition can thus be reduced considerably, so that the overall distance and space requirement needed for the movements of the handling elements is relatively small. By reducing the distances to be traveled, the handling elements and their drives can also be made smaller. This results in cost savings in manufacture, to an overall more compact and simpler construction of the service unit and has the additional advantage that maintenance of the service unit is also simplified in this manner.

In the sense of the present invention, all those elements which take over the yarn from the presentation device and move it in order to deliver the yarn again to the open-end spinning device are understood to be handling elements.

In an advantageous embodiment of the process of the invention, it is possible for a first joint movement phase and then an additional joint movement phase to take place, or the reverse sequence can be provided for.

A process that has proven itself to be especially advantageous involves bringing the yarn end into a readiness position before the joint motion phase, since in this way the handling elements are able to carry out their operational movements in a simple and distance-saving manner.

The joint movement phase is advantageously determined so that it represents the overall motion of at least one of the handling elements, as in this manner no individual movement phase is required for individual handling elements. Here it is advantageous if the yarn end is presented to the open-end spinning device by this joint movement phase.

By determining the joint movement phase so that the handling elements interacting with the open-end spinning device carry out their task subsequent to the joint motion phase, especially favorable conditions are created with regard to space and material requirements.

The individual movement phase of each individual handling element is adapted to the current requirements and can also be sub-divided into several movement phases.

According to the invention, the placement of the handling elements on a bearing device which can be moved by a controlled drive device makes it possible to bring the handling elements together from a first into a second or further position, it being immaterial whether the first or the second or further position is the position in which the individual handling elements carry out their possibly additionally required individual operational movements.

According to an alternative embodiment, a linear movement is preferably associated with the bearing device.

It has been proven to be advantageous for the bearing device to be configured substantially in the form of a plate. Here an arrangement is especially advantageous if the plate is oriented in a plane perpendicular to the longitudinal axis of the machine.

The carrier is controlled as a function of a program provided by the previously mentioned control device, whereby its movement from one into the other work position is controlled preferably only after execution of defined operations by the handling elements.

In an advantageous embodiment of the device according to the invention, the feeding device can be driven by the carrier alone, so that an individual drive becomes superfluous. Here it is possible to provide for the yarn reserve hoop to be mounted on the feeding device.

The device according to the invention is not only suited to piece a yarn anew after a yarn breakage. It is also possible to use the device according to the above-described invention when an auxiliary yarn is used for piecing after a bobbin replacement and is transferred to the normal bobbin only after successful piecing.

The process and the device according to the invention distinguish themselves in that they create conditions allowing the different handling elements to move through relatively short operational distances. As a result of this, the entire device becomes more compact, controllable and maintenance-friendly.

Examples of embodiments of the invention are explained in further detail below with the help of drawings.

DETAILED DESCRIPTION OF THE PREFERRED EMBODIMENTS

Figure 1:
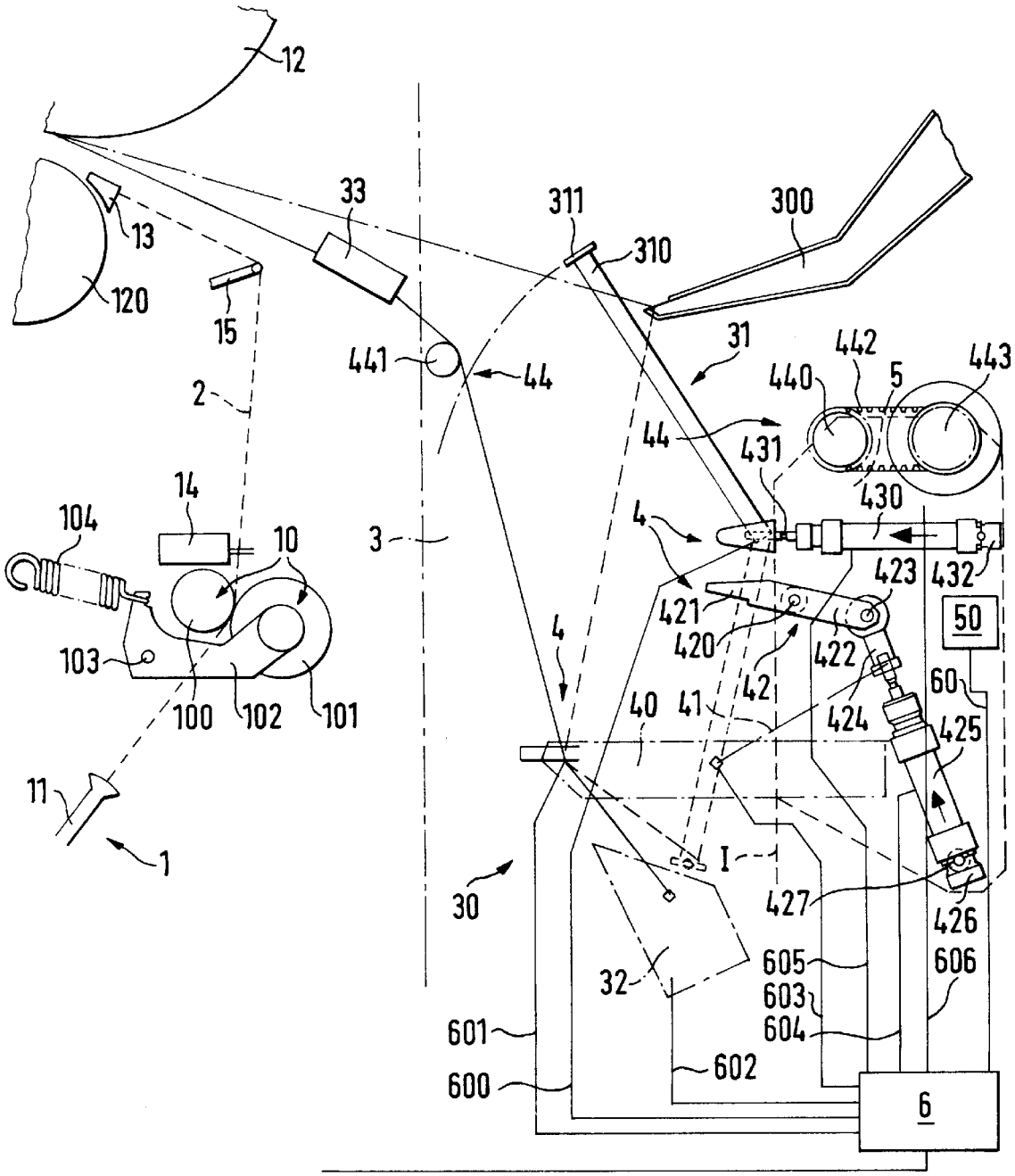
FIGS. 1 to 4 schematically show a side view of the parts of an open-end spinning machine necessary for the piecing of a yearn and a piecing device made in accordance with the invention.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment can be used on another embodiment to yield still a further embodiment.

FIGS. 1 to 4 show part of an open-end spinning machine with a plurality of identical open-end spinning devices placed next to each other in the longitudinal direction of the machine, i.e. they extend in the direction of the longitudinal axis of the machine. The individual open-end spinning devices 1 are designed in the conventional manner and are therefore not shown in further detail. Each open-end spinning device 1 is therefore equipped with a spinning rotor (not shown) to which fibers are fed in the usual manner and are spun into the end of a yarn 2 which is drawn off by means of a pair of draw-off rollers 10 through a yarn draw-off pipe 11 and are wound up on a bobbin 12 driven by a winding roller 120, whereby it is deposited on this bobbin 12 in a cross-wound manner by means of a traversing yarn guide 13. The yarn 2 goes in this case through a yarn tension monitor 14 which monitors the tension of the spun yarn 2, and runs over a yarn tension compensating hoop 15 which ensures constant winding tension.

The pair of draw-off rollers 10 consists of a driven roller 100 and a pressure roller 101 which is mounted pivotably by means of a swivel arm 102 on an axle 103 and is held pressed against the driven roller 100 by a tension spring 104 anchored on the machine frame which is not shown here.

Along the open-end spinning devices 1 of the open-end spinning machine travels a service unit 3 in the form of a service carriage, with a piecing apparatus 30 of which only those elements are shown which are necessary to understand the invention. The service unit 3 is able to stop at every open-end spinning device 1 requiring servicing to carry out a service task.

It goes without saying that the service unit 3 may be equipped with devices in addition to the piecing apparatus 30 described in detail below, e.g. a bobbin replacement device (not shown) etc., but which are not of importance in connection with the process to be described and the device to be explained.

The piecing apparatus 30 is provided with a swiveling suction pipe 300 in the embodiment as shown in FIGS. 1 to 4, which locates the end of a broken yarn 2 in a known manner on the bobbin 12 and then presents it to a device 31 which in turn holds the yarn 2 and presents it to a group of handling devices 4. The handling devices 4 comprise those elements which receive the yarn 2 from the presentation device 31 and move it until the yarn 2 is again transferred to the open-end spinning device 1. The individual handling devices 4 are mounted together with their individual drives on a common bearing device 5.

Figure 5:
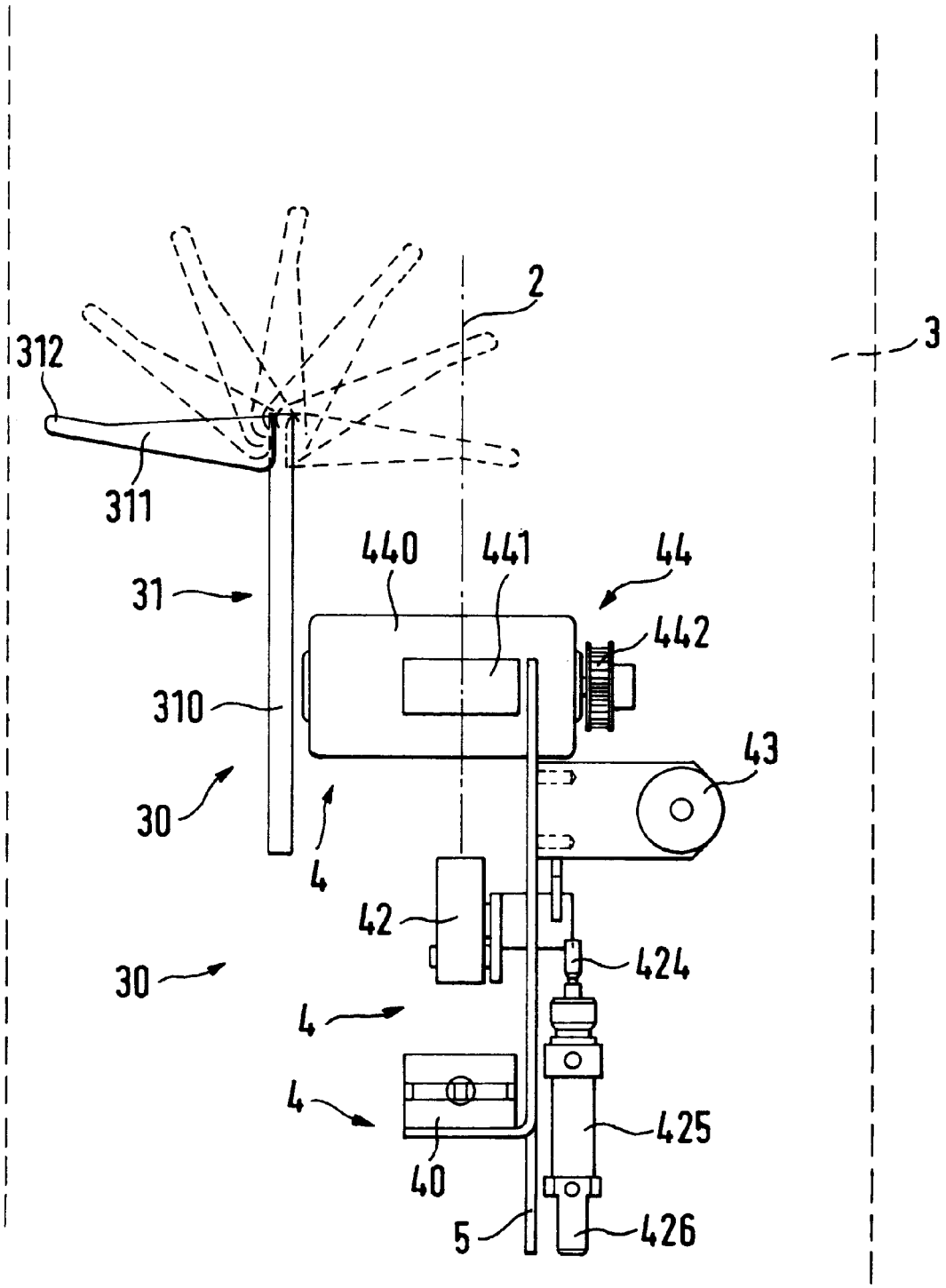
FIG. 5 shows the handling elements on the service unit which are required for piecing, in a front view.

In the embodiment shown, the presentation device 31 is made in form of a swiveling yarn catcher 310. The latter is provided on its free end with a swivel arm 311 with a known combined catching and cutting element 312 (FIG. 5).

The yarn catcher 310 presents in its lower end position yarn 2 to a yarn preparation device 32 which is stationary in the service unit 3.

A feed device 40 which is provided on its end away from the bearing device 5 with an opening and closing pair of rollers (not shown) is rigidly connected to the bearing device 5.

A swiveling yarn reserve hoop 41 is pivotably mounted on the feed device 40. Thanks to the placement of the yarn reserve hoop 41 at this location, the size of the yarn reserve can easily be adapted to requirements.

Furthermore, a pressure roller actuating lever 42 which is pivotably mounted on an axle 420 supported by the bearing device 5 is also located on the bearing device 5. One arm 421 extending beyond the contour of the bearing device 5 has the task of lifting the pressure roller 101 from the driven roller 100. For this purpose, the other arm 422 of this two-arm lever 420 is connected via an articulation 423 to one end of a piston 424 which extends into a drive cylinder 425. The drive cylinder 425 is connected via a connection 426 to a channel through which the drive cylinder 425 is supplied a suitable liquid or gaseous control medium or through which it can be removed from same. The drive cylinder 425 can be swiveled by means of an axle 427 and is mounted on the bearing device 5.

An additional drive cylinder 430 is mounted on the bearing device 5, its piston 431 bearing on its free end an element 43 to actuate the yarn tension monitor 14 during the piecing phase. The drive cylinder 430 is not pivotably mounted and is connected via a connection 432 to a channel (not shown) for the supply and removal of a suitable control medium.

Furthermore, a pair of piecing rollers 44 is installed on the bearing device 5, its one roller 440 being connected via a toothed belt to a drive motor 443 which drives it. The other roller 441 of the pair of piecing rollers 44 is stationary and mounted in the service unit 3 and placed in it in such manner that the driven roller 440 can be brought to bear against this stationary roller 441.

Figure 2:
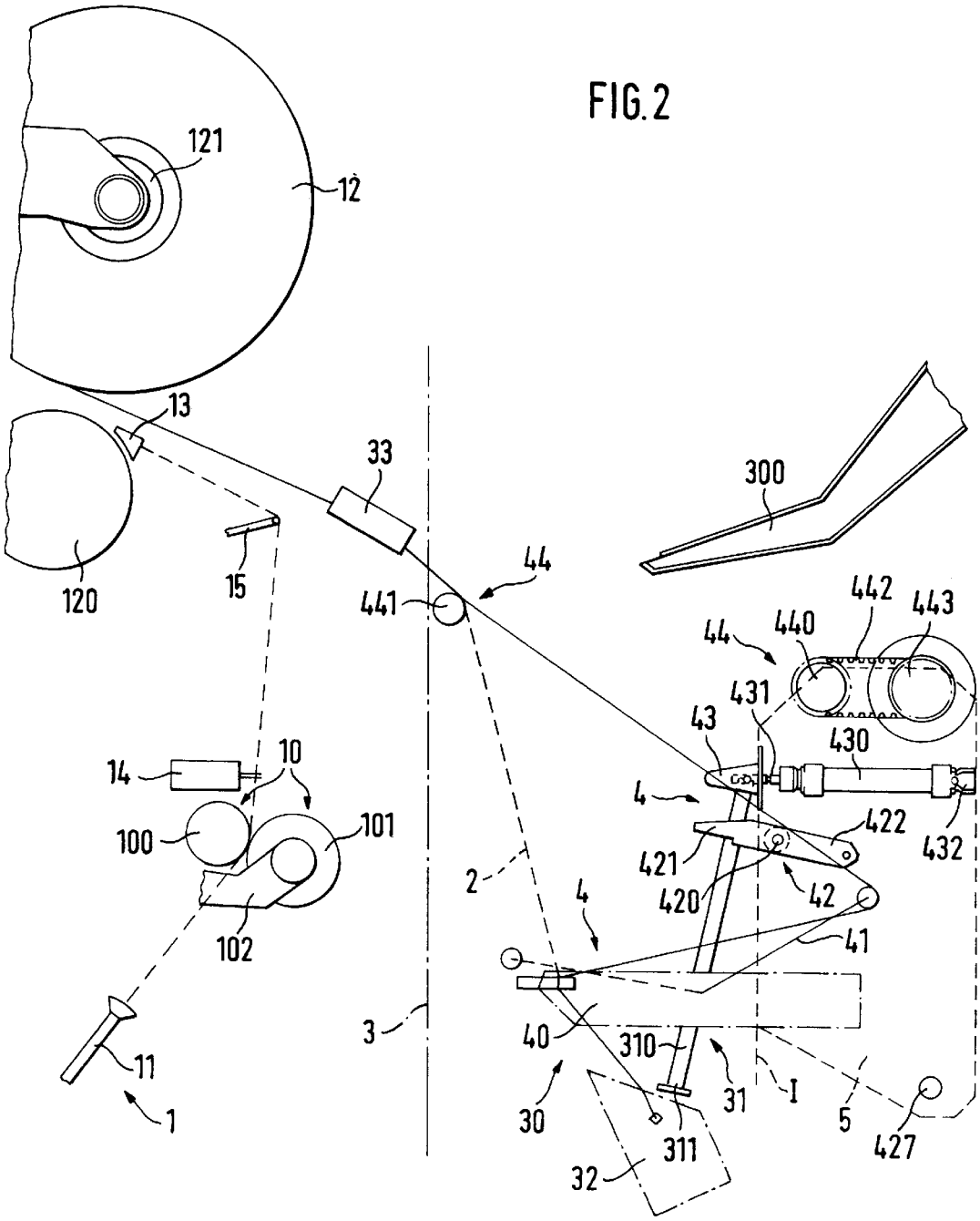
Figure 3:
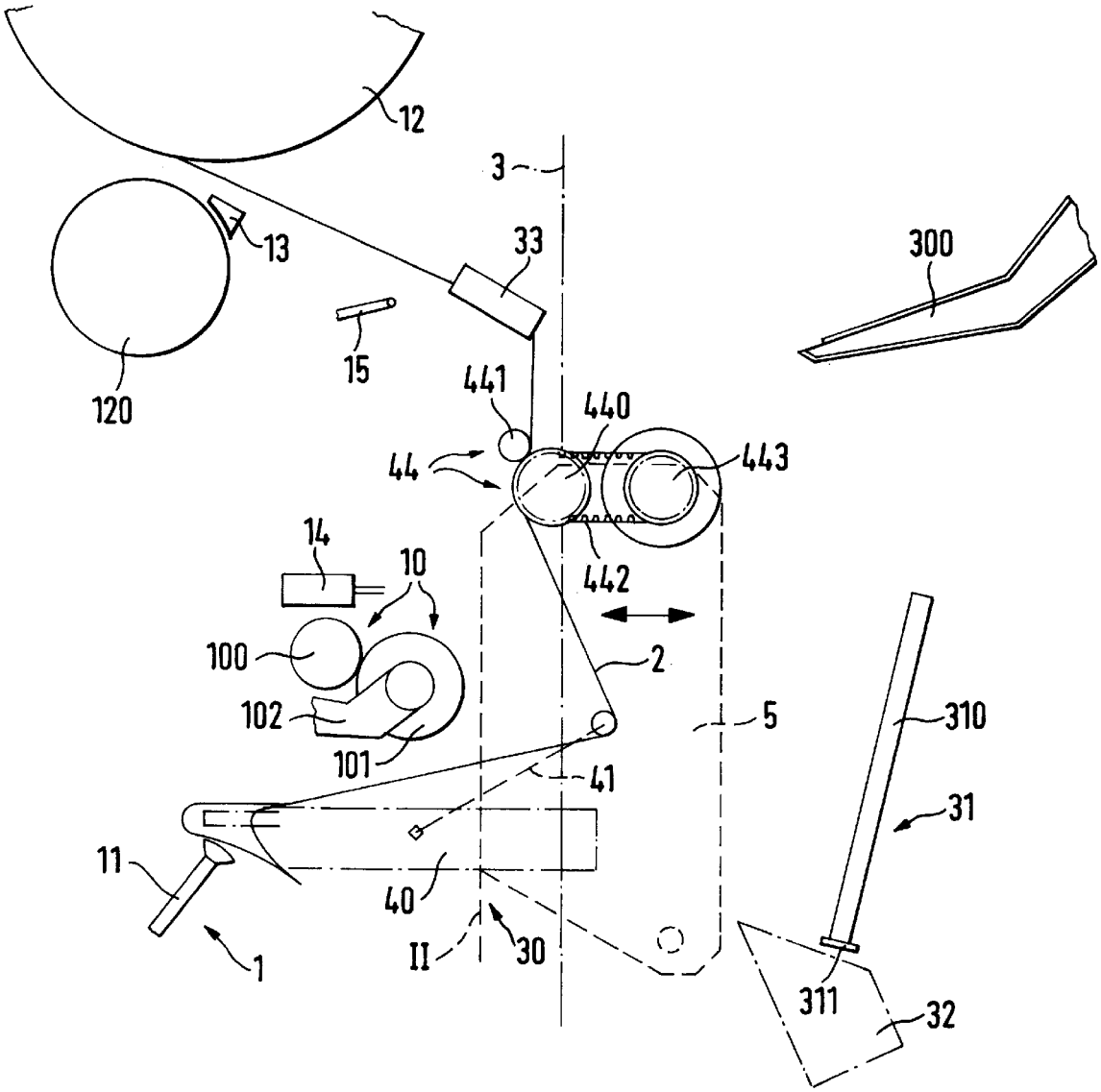
Figure 4:
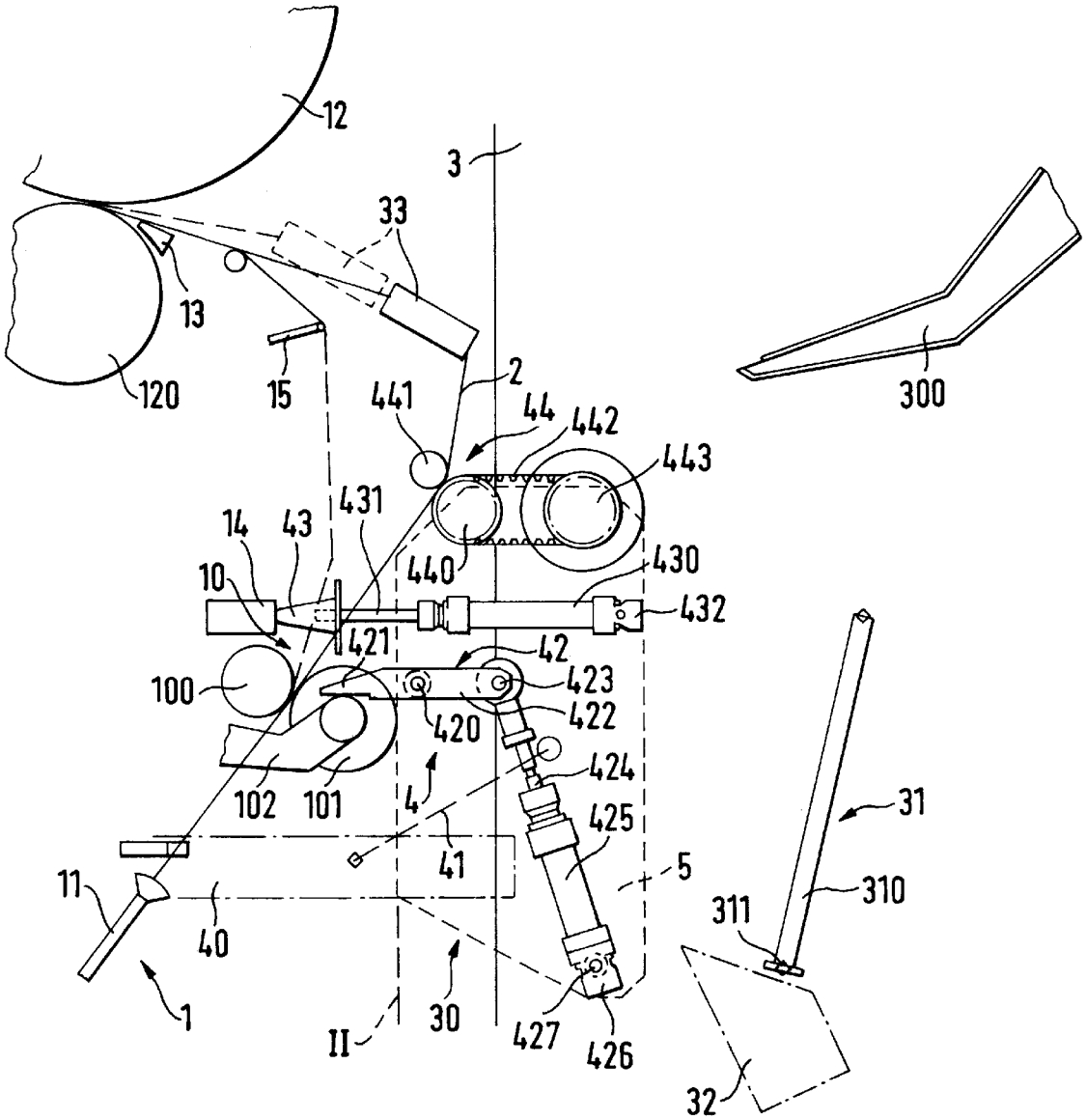

The bearing device 5 is assigned a drive 50 by means of which it can be moved between at least two work positions I and II (compare FIGS. 1 and 2 with FIGS. 3 and 4).

The swivel drive of the yarn catcher 310 which is not shown, as well as its cutting element 312 (FIG. 5), the roller pair of the feed device 40 which can be opened and closed and is also not shown, the yarn end preparation device 32 , the not shown swivel drive of the yarn reserve hoop 41, the drive cylinder 425 or its supply line for the control of the pressure roller-actuating lever 42, the drive cylinder 430 or its supply line for the control of the element 43 for the actuation of the yarn tension monitor 14, the drive motor 443 of the pair of piecing rollers 44 and also the drive 50 of the bearing device 5 are connected via control lines 600 to 606 as well as 60 to a control device 6 which is installed on the service unit 3 and is connected via an additional control line to a not shown control device in the open-end spinning machine itself. The control device 6 on the service unit 3 controls among other things the execution of a piecing process according to the event signaled by the control device on the machine (not shown), e.g. a yarn breakage or the need for a bobbin replacement followed by a piecing process.

For reasons of clarity the control device 6 and the control lines 60 to 600 and 606 as well as drive 50 of the bearing device 5 are shown only in FIG. 1. Also the representation of different handling elements 4 or of parts thereof was omitted in FIGS. 2 to 5 for reasons of clarity.

Additional devices are connected via control lines which are not shown to the control device 6, e.g. the swivel drive and the air control of the suction pipe 300. An additional such device is a swiveling pneumatic yarn storage device 33 which is mounted pivotably in the service unit 3 (see FIG. 7). This drive as well as the air control are connected by means of a control line which is not shown (as mentioned previously) to the control device 6.

During undisturbed spinning, the yarn 2 which is drawn off by the pair of draw-off rollers 10 from the open-end spinning devices 1 leaves the open-end spinning device 1 through the yarn draw-off pipe 11, passes the yarn tension monitor 14 and reaches the bobbin 12 driven by the winding roller 120 where it is wound up (see dotted line representation in FIG. 1) If a yarn breakage occurs, it is recorded by the yarn tension monitor 14 which signals to the previously mentioned and not shown control device on the machine, which then calls the service unit 3 to the affected spinning station or stops it as it next passes the affected open-end spinning devices 1.

In case of a yarn breakage, additional functions are furthermore triggered in a known manner, e.g. the restriction of fiber feed to the spinning rotor, (not shown) which is stopped. Furthermore the bobbin 12 is lifted from the winding roller 120. The yarn 2 now at the latest leaves the traversing yarn guide 13.

Once the service unit 3 has stopped at the affected open-end spinning device 1, the suction pipe 300 is swiveled by appropriate control of the control device 6 towards bobbin 12. Furthermore, a drive roller (not shown) slaved by the service unit 3 is pressed against the bobbin 12 and is then driven in unwinding direction, whereby the yarn 2 released by the bobbin 12 is sucked into the suction pipe 300. Subsequently the bobbin 12 is briefly driven in winding direction in order to bring the yarn into a defined yarn based on the winding tension and absence of traversing.

The control device 6 now causes the presentation device 31 (yarn catcher 310) to be swiveled from a lower rest position (shown in broken lines) upwards until it is above the yarn path between bobbin 12 and suction nozzle 300. In this position of the yarn catcher 310 its swivel arm 311 is swiveled from the top in such a manner that it catches the yarn 2 extending towards the bobbin 12 with its catching and cutting element 312 (see FIG. 5). The yarn catcher 310 now swivels down and at the same time pulls the yarn 2 with it. In this process the presentation device 31 (yarn catcher 310) lays the yarn 2 into the nip of the open roller pair (not shown) at the free end of the feed device 40. The two rollers of this roller pair are then again brought into contact with each other, so that the yarn 2 is held between them. Now the yarn 2 is cut by the cutting element 312 of the yarn catcher 310 and is thus cut to a defined length. The yarn end extending into the suction pipe 300 is sucked away by the latter and removed.

In its swiveling motion as it goes into its rest position, the yarn catcher 310 presents the yarn 2 with its catching and cutting element 312 also to the yarn preparation device 32. The yarn 2 is now aspired by a negative pressure applied in the yarn preparation device 32, so that it may be given in the yarn preparation device 32 a defined form which is especially suited for piecing.

Once the feed device 40 has clampingly held the yarn 2, the bobbin 12 is temporarily driven in unwinding direction by means of the drive roller which is not shown. The yarn 2 fed back is taken up by the yarn storage device 33 which has in the meantime been subjected to negative pressure, and which is in its work position as shown in FIG. 1.

Next the yarn reserve hoop 41 is brought out of its position shown by broken lines in FIG. 2 into the position shown by a full line and is readied in this manner and brought to the required yarn length for subsequent return of the yarn 2 into the spinning rotor of the open-end spinning device 1.

The yarn 2 which is to be fed to the open-end spinning device 1 for piecing is now in a readiness position from which it must be moved towards the open-end spinning device 1 for presentation before same.

The work steps described above are carried out while the bearing device 5 with the handling devices 4 is still in its starting position (work position I) . The handling devices 4 otherwise needed for piecing are until now all in a retracted position, since their bearing device 5 has been during the entire time in its work position I. The swiveling range of the presentation device 31 as well as the yarn entry area between the suction pipe 300 and the feed device 40 is thereby kept free and it is not necessary for that reason to provide movements of great length and correspondingly large dimensions for handling devices 4 to be used later. For the operations which now follow, i.e. after the execution of a predetermined number of operations, the bearing device 5 with the handling devices 4 which it carries is brought into its second work position II (FIG. 3) , with all the handling devices 4 carrying out a joint motion phase. During this joint motion phase the feed device 40 which is rigidly connected to the bearing device 5 pulls the yarn end out of the yarn preparation device 32 and conveys it so far beyond the outlet of the yarn draw-off pipe 11 that the yarn end reaches with certainty the area of influence of the air stream applied in this yarn draw-off pipe 11 and is aspired. The yarn end is thus presented to the open-end spinning device 1 by the joint motion phase, i.e. as the bearing device 5 is moved from its one work position I into its other work position II.

Furthermore the yarn surplus produced by the shortening of the yarn path is taken up by the pneumatic yarn storage device 33.

As the bearing device 5 moves into its work position II, i.e. in the joint motion phase of the handling devices 4, the roller 440 of the pair of piecing rollers 44 comes to bear against its stationary roller 441 and clampingly holds the yarn 2. Now the pair of rollers of the feed device 40 as well as the rollers 440 and 441 of the pair of piecing rollers 44 are driven in order to feed back a predetermined yarn length into the yarn draw-off pipe 11. The pair of rollers of the feed device 40 the releases the yarn 2. The yarn 2 is located with its end in a waiting position inside the yarn draw-off pipe 11.

So that the yarn 2 may again be able to enter the pair of draw-off rollers 10 on the machine after successful back-feeding, the actuating lever 42 of the pressure roller is brought to bear against the pressure roller 101 in order to lift it from the driven roller 100.

Coordinated in time with each other, the normal spinning conditions are now re-established in a known manner, whereby among others the spinning rotor is again connected to its drive and the fiber feed to the spinning rotor is again resumed. Furthermore the bobbin 12 is lowered again, so that it is again driven by the winding roller 120 (FIG. 4). A yarn monitor (not shown) in the pneumatic yarn storage device 33 monitors the stored yarn length and in function of the stored yarn remnant length causes the release of the yarn 2 in a known manner, e.g. by throwing it off the yarn reserve hoop 41. As a result of the negative pressure flow in the spinning rotor and in the yarn draw-off pipe 11, the yarn 2 is thus sucked into the spinning rotor where the newly fed fibers can be incorporated into the yarn end.

During this piecing phase, the yarn 2 is not yet under normal spinning tension. For this reason the element 43 comes to bear upon the yarn tension monitor 14 and simulates normal tension.

In timely coordination with the throwing off of the yarn 2 for piecing, the earlier mentioned and not shown drive roller is set on the bobbin 12 which has again been lowered on the winding roller 120 assists in driving the roller 12 in the direction of winding. The pressure roller 101 is the again released by the pressure roller actuating lever 42 so that the pair of draw-off rollers 10 can again draw off the yarn 2 from the spinning device 1. The drive roller of the bobbin 12 is lifted from the latter. A yarn surplus generated during this work phase is taken up by the pneumatic yarn storage device 33 which is now moved in the direction of bobbin 12, whereupon the pair of piecing rollers 44 releases the yarn 2. The yarn surplus which is generated in this process is again taken up by the yarn storage device 33. Due to the wind-up tension the yarn reserve stored in the yarn storage device 33 is reduced, whereby the tension jump during exhaustion of the stored yarn length is minimal due to the yarn storage device 33 which was previously swiveled in the direction of bobbin 12.

The piecing process is thereby completed. The different handling devices 4 and the bearing device 5 return to their starting positions. The service unit 3 then resumes its travel in order to service other open-end spinning devices 1.

In the preceding description only those work steps were mentioned in detail which are functionally associated with the handling devices 4 and their bearing device 5. In all other respects the piecing process is carried out in a known manner.

The bearing device 5 is made essentially in the form of a plate in the described embodiment. On its two sides the individual handling devices 4 with their individual drives are placed and attached with suitable holders, as shown in the example of several handling devices 4. In principle a horizontal orientation of this plate is possible; since however the movement of the yarn 2 is from the top, i.e. from the bobbin, downwards, an orientation of this plate in a vertical plane, i.e. a plane perpendicular to the longitudinal axis of the machine, is especially advantageous.

In the embodiment described, several of the handling devices 4 go through individual motion phases, these being carried out in part before the joint motion phase (e.g. pulling up the yarn reserve by means of the yarn reserve hoop 41), while other handling devices 4 run through an individual motion phase only following this joint motion phase ( pressure roller actuating lever 42, throwing off the yarn reserved from the yarn reserve hoop 41, actuation of the yarn tension monitor 14 by means of the element 43). Of the mentioned handling devices 4, all with the exception of the feed device 40 and the pair of piecing rollers 44 go through an individual motion phase, even if in different sequences, while the joint motion phase is sufficient for the feed device 40 and the pair of piecing rollers 44 to carry out the task of these handling devices 4. Individual drives to offset these handling devices 4 are therefore superfluous.

In principle, the sequence of the motion phases (joint and individual) is of no significance, but in the sequence described here, in which the yarn end is brought before the open-end spinning device 1 in a readiness position before the joint motion phase is initiated, individual motion phases and the drives which would otherwise be required for them can be omitted very advantageously. This is accomplished due to the fact that the joint motion phase corresponds to the joint movement of two handling devices 4, i.e. that of the feed device 40 and of the pair of piecing rollers 44.

As the above description shows, the point in time to go through the joint motion phase is selected as much as possible so that the handling devices 4 (rollers of the feed device 40, pressure roller actuating lever 42, element 43) interacting with the elements (yarn draw-off pipe 11, pressure roller 101, yarn tension monitor 14) are used only following this joint motion phase, so that thereby the previously mentioned small space requirement (smaller sizes of these handling devices 4 and shorter individual work path) are attained.

As the above description shows through the example of the yarn reserve hoop 41, the individual motion phase of a handling devices 4 can also be subdivided into several motion segments. Thus the yarn reserve hoop 41 pulls up a yarn reserve before the joint motion phase is carried out, and releases the yarn 2 after going through this joint motion phase.

Figure 6:
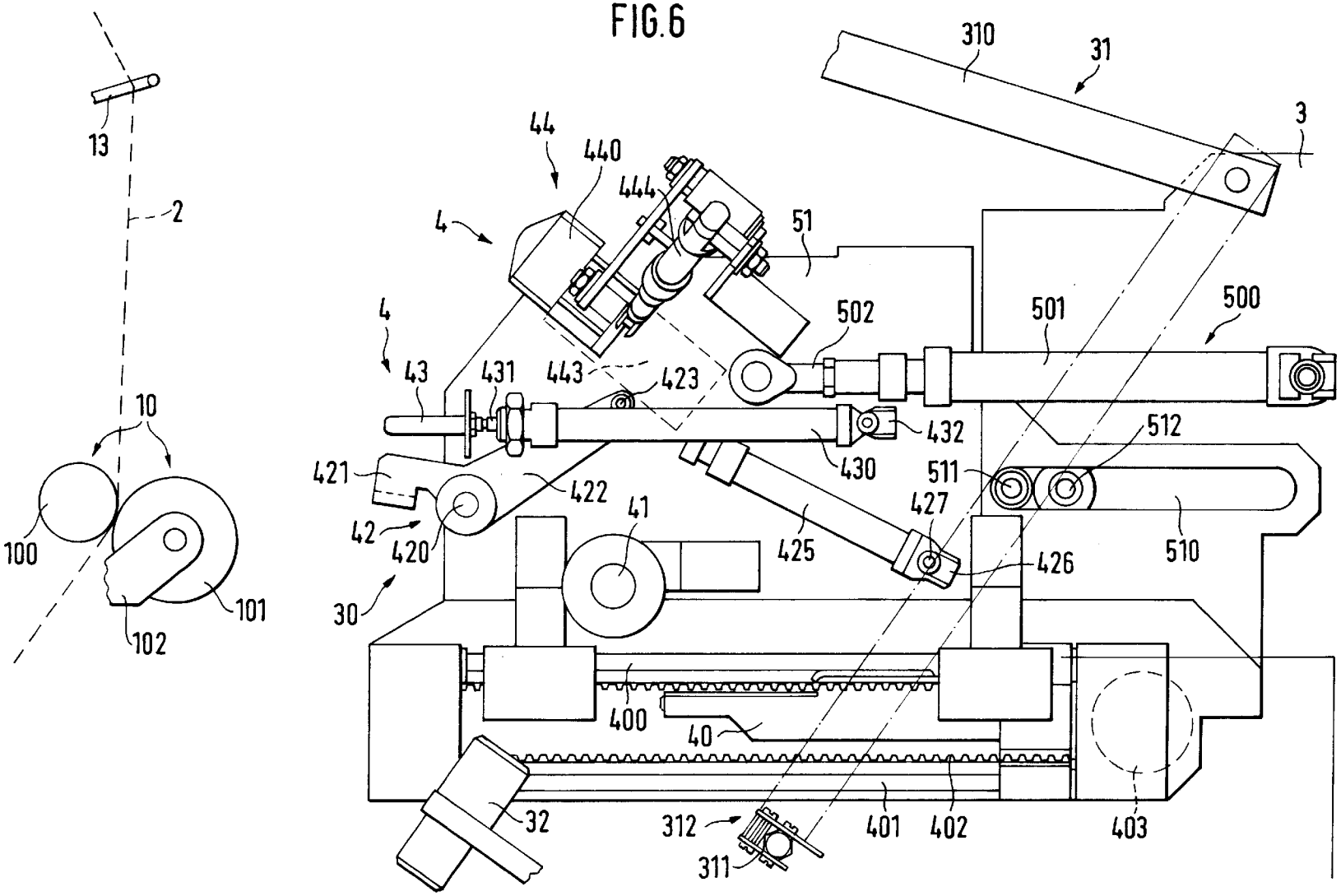
FIG. 6 shows a variant of the device according to the invention shown in FIGS. 1 to 4 with the bearing plate for the handling elements in its starting position.

FIG. 6 shows a carrier 51 which follows a linear movement in the service unit 3 in a manner not shown here. The carrier 51 has a slit 510 extending in the direction of movement into which two pins 511 and 512 held by the service unit 3 extend. Together with the slit, these two pins 511 and 512 constitute a stroke limit in both directions for the carrier 51.

The drive 500 of the carrier 51 is in this embodiment formed by a drive cylinder 501 mounted on the service unit 3 and by its piston 502 whose ends protruding form the drive cylinder 501 are connected to the carrier 51. The cylinders 501 are controlled in the usual manner as a function of the control by the control device 6. (See FIG. 1)

The feed device 40 can move relative to the carrier 51 in this embodiment of the piecing apparatus 30. For this purpose it is mounted by means of guide rails 400 and 401 on the carrier 51 and is connected to a chain 402 or similar device which is driven by a drive motor 403. This drive motor is controlled from the control device 6. By contrast to the device shown in FIGS. 1 to 5, the yarn 2 is merely inserted into the rollers (not shown) of the feed device 40 by the movement of the presentation device 31 according to FIG. 6. The yarn 2 is fed to the yarn preparation device 32 by the advance movement of the feed device 40 which is caused by the movement of the carrier 51. In order to present the yarn 2 at the proper moment to the yarn draw-off pipe 11, the feed device 40 is driven relative to the carrier 5 by means of the drive motor 403.

By contrast with the embodiment described in FIGS. 1 to 4, the pair of piecing rollers 44 extends at a right angle to the yarn course, so that when the carrier 51 goes from work position I into its work position II, the yarn 2 enters its nip and is pulled out of the pair of piecing rollers 44 as the carrier 51 moves back. In principle, control of the pair of piecing rollers 44 is thereby needed only for the purpose of yarn conveying, not to catch or release the yarn 2. Nevertheless, as shown in FIG. 6, the roller 441 can be lifted from the driven roller 440. This is done by means of a drive cylinder 444 which is mounted in a suitable manner and is connected via its piston to the roller 441 (see FIGS. 1 to 5).

Additional handling devices 4 are not shown in FIG. 6 since their design is analogous to that of the handling elements 4 of FIGS. 1 to 5. The function of this modified device also follows the principle of the device shown in FIGS. 1 to 5.

In this embodiment too, the advance movement of the carrier 51 corresponds to an operational motion; by moving the carrier 51, the yarn is inserted into the yarn preparation device 32 with the assistance of the feed device 40.

The described device, as well as the process described above, can be modified in many ways within the framework of the present invention, e.g. through different combinations of characteristics, through other designs of the individual components or by replacement of characteristics by equivalents. Thus for example, a linear movement of the carrier 5 or 51 was described earlier. It is however also possible to move the carrier 5 or 51 along an arc of circle or along any curve, if this is an advantage in eliminating individual drives for one or several handling elements.

As explained earlier, the bearing device 5 can be brought into at least two work positions I and II. Depending on the design of the handling devices 4 and their individual drives, more than two work positions can also be provided if necessary. Thus it is possible for the presentation of the yarn end before the yarn draw-off pipe 11 to first bring the bearing device 5 as described in a position in which the yarn end is located above the outlet of the yarn draw-off pipe 11, but in which the end of the feed device 40 away from the bearing device 5 is located on the side of the yarn draw-off pipe 11 away from the bearing device 5 (second work position II) from which the bearing device 5 is moved back into a third work position (not shown) so that the yarn 2 may then take the shortest route from the roller pair of the feed device 40 into the yarn draw-off pipe 11.

Various elements can be used as drive 50 or 500, e.g. instead of the drive cylinder 501, it is also possible to use a chain, a toothed rod, etc.

The presentation device 31 can also be given different designs, e.g. in form of a pneumatic element.

Figure 7:
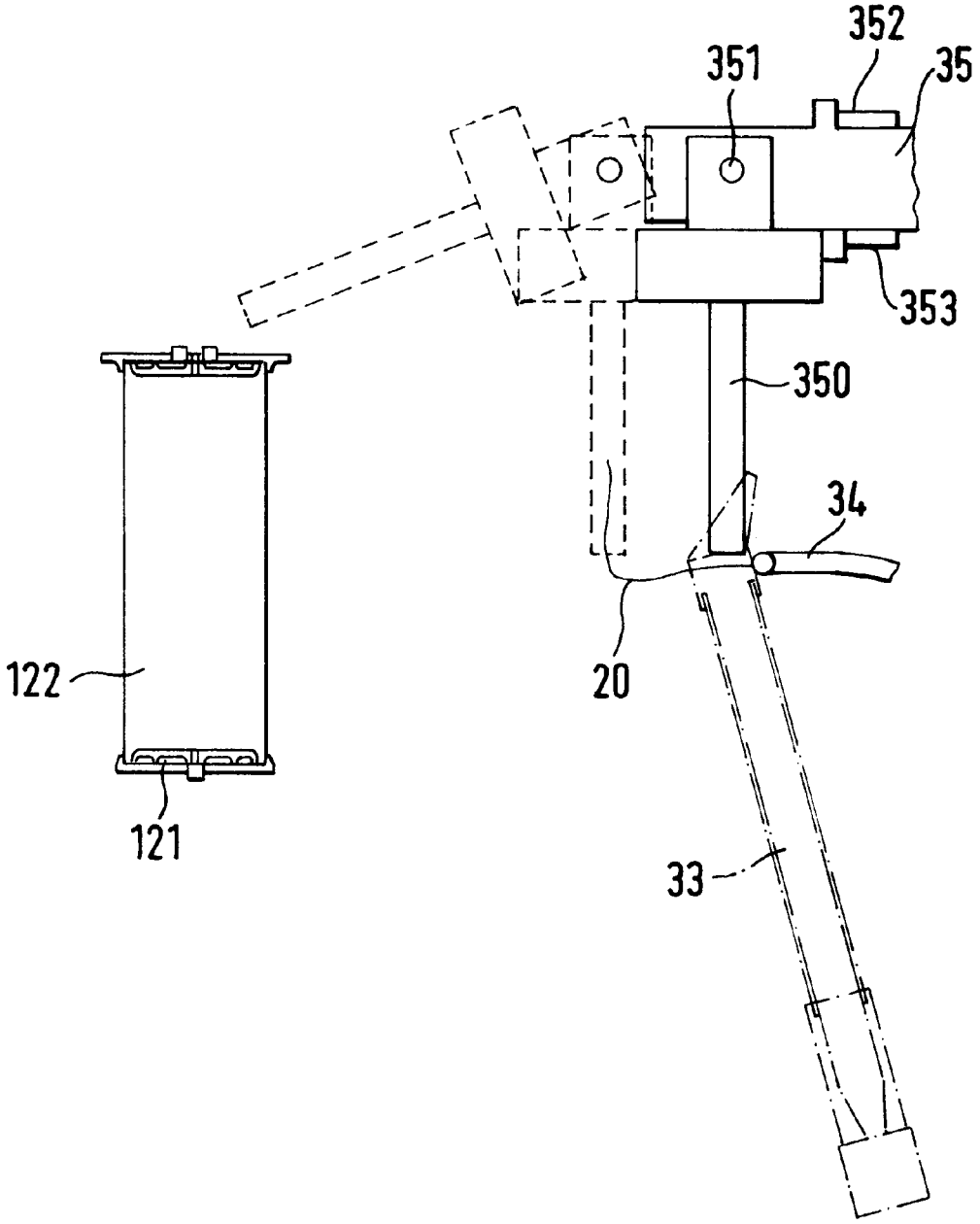
FIG. 7 shows another variant of the device according to the invention for piecing of an auxiliary yarn presented by the service unit, in a top view.

In the embodiments described so far according to FIGS. 1 to 6 it was assumed that the yarn 2 for piecing is taken up by the bobbin 12 on the machine. This is however not essential for the present invention. It is absolutely possible to provide a piecing bobbin in a known manner on the service unit 3 from which a yarn 20 (auxiliary yarn) is conveyed to the outlet of a yarn conveying pipe 34 and is held there (FIG. 7). At the end of a suction pipe 35, a suction pipe 350 for the creation of a yarn reserve is provided pivotably and capable of displacement in the longitudinal direction of the suction pipe 35 and at an angle thereto. For this purpose, the suction pipe 350 is connected by means of an air-carrying articulation 351 on the free end of the suction pipe 35 which supports driven guide rails 352 and 353 by means of a drive which is not shown. In every other respect the same elements, in particular handling devices 4 as in the device according to FIGS. 1 to 6 are being used for the piecing process.

In a service unit 3 with bobbin replacement device and piecing apparatus 30, the bobbin 12 on the machine is thus assigned a first suction pipe 300 and the not-shown piecing bobbin on the service unit 3 is assigned a second suction pipe 350, whereby the presentation device 31 can be presented to either one of the two suction pipes 300 and 350 to receive the yarn 2 or 20 as needed. This presentation device 31 then transfers the yarn 2 to the very same handling devices 4, whatever the type of piecing operation may have to be carried out (following yarn breakage of bobbin replacement).

The device the design of which is described with the help of FIG. 7 functions as follows:

The end of yarn 20 is located in the suction pipe 34 and is brought out of the outlet of the yarn conveying pipe 34 as needed through means not shown here, e.g. by means of compressed air. The yarn beginning thus reaches the action range of a suction air flow sucked into the suction pipe 350 and follows it. When the suction pipe 350 has received a sufficient length of yarn, so that the yarn 20 is held securely, the suction pipe 350 is shifted relative to the suction pipe 35, so that the outlet of the suction pipe 350 is located at a distance from the outlet of the yarn conveying pipe 34. The yarn 20 now extends between these two outlets and at the same time passes the outlet of the pneumatic yarn storage 33. The presentation device 31 is now able to take up this yarn 20 between the two outlets and to convey it in the manner described above to the feed device 40 as well as to the yarn preparation device 32. At the proper point in time, the yarn 20 is now cut by the cutting element 312 of the yarn catcher 310 in the manner described in FIGS. 1 to 4. In timely coordination therewith, the yarn end extending to the yarn conveying pipe 34 is cut by a cutting device which is not shown inside the yarn conveying pipe so that it can be sucked into the yarn storage 33 and be removed.

All other operations are now carried out in the manner described in FIGS. 1 to 6.

After a successful piecing operation, the yarn 2 is first sucked into the suction pipe 350 until the piecing joint created during piecing has been pulled away. The suction pipe 350 is then swiveled towards the bobbin tube 122 driven by the winding roller 120 where the yarn 20 drawn off continuously in the meantime is seized by bobbin plate 121 which rotates together with the bobbin 12. The yarn cutting device which is installed at a suitable location then cuts the yarn 20 so that the yarn 20 which is constantly being delivered by the open-end spinning device 1 is now wound up on the bobbin 12 which forms on the bobbin tube 122, while the severed yarn end is removed through the suction pipe 350. The piecing operation is thus completed. The service unit 3 can now continue on its way.

It will be apparent to those skilled in the art that various modifications and variations can be made in the present invention without departing from the scope and spirit of the invention. It is intended that the present application cover such modifications and variations as come within the scope of the appended claims and their equivalents.

I claim:

1. A process for piecing of a yarn at a spinning device of an open-end spinning machine wherein a service unit travels alongside individual spinning devices of the spinning machine for performing said piecing, said process comprising:

acquiring a yarn end at the spinning device with a suction pipe movably mounted on the service unit;

taking the yarn end from the suction pipe with a presentation device movably mounted on the service unit and delivering the yarn end with the presentation device to a yarn preparation device mounted on the service unit wherein the end of the yarn is held and prepared for piecing;

the service unit including a bearing device that is movably mounted on the service unit and movable from a first work position relative to the service unit to a second work position closer to the spinning device, the bearing device having a plurality of handling elements mounted thereon for carrying out subsequent piecing functions as the bearing device is moved form its first work position to its second work position, said process further comprising;

moving the bearing device from its first work position to its second work position wherein in a joint motion phase of the handling elements mounted on the bearing device, the handling elements pull the yarn end out of the yarn preparation device, present the yarn to a yarn draw-off tube of the spinning device, and backfeed the yarn into the yarn draw-off tube all after or during movement of the bearing device to its second work position, and wherein said step of backfeeding the yarn comprises bringing a driven piecing roller handling element of the handling elements to bear against a piercing roller on the spinning device wherein the yarn passes between the rollers in the joint motion phase as the bearing device is moved from its first work position to its second work position, and subsequently driving the driven piercing roller to backfeed the yarn into the yarn draw off tube.

2. The process as in claim 1, wherein the handling elements mounted on the bearing device include a feed device handling element, said steps of pulling the yarn end out of the yarn preparation device and presenting the yarn to the yarn draw-off tube accomplished by the feed device handling element in the joint motion phase as the bearing device is moved from its first work position to its second work position.

3. The process as in claim 2, further comprising moving the yarn to the feed device with the presentation device prior to delivering the yarn end to the preparation device as the bearing device is in its first work position.

4. The process as in claim 1, further comprising engaging the yarn with a yarn reserve hoop handling element movably mounted on the bearing device after the yarn end is held by the preparation device and as the bearing device is in its first work position for bring the yarn to a required yarn length for piecing.

5. The process as in claim further comprising bringing an actuating lever handling element mounted on the bearing device to bear against a pressure roller on the spinning device in the joint motion phase as the bearing device is moved from its first work position to its second work position.

6. A process for piecing of a yarn at a spinning device of an open-end spinning machine wherein a service unit travels alongside individual spinning devices of the spinning machine for performing said piecing, said process comprising:

acquiring a yarn end at the spinning device with a suction pipe movably mounted on the service unit;

taking the yarn end from the suction pipe with a presentation device movably mounted on the service unit and delivering the yarn end with the presentation device to a yarn preparation device mounted on the service unit wherein the end of the yarn is prepared for piecing and held;

the service unit including a bearing device that is movably mounted on the service unit and movable from a first work position relative to the service unit to a second work position closer to the spinning device, the bearing device having a plurality of handling elements mounted thereon for carrying out subsequent piecing functions as the bearing device is moved form its first work position to its second work position, said process further comprising;

moving the bearing device from its first work position to its second work position wherein in a joint motion phase of the handling elements mounted on the bearing device, a feed device handling element pulls the yarn end out of the yarn preparation device and presents the yarn to a yarn draw-off tube at the spinning device as the bearing device is moved from its first work position to its second work position; an actuating lever handling element mounted on the bearing device is brought to bear against a pressure roller on the spinning device as the bearing device is moved from its first work position to its second work position; and a driven piecing roller handling element is brought to bear against a rotatable piecing roller on the spinning device as the bearing device is moved from its first work position to its second work position, the yarn passing between the piecing rollers and wherein the driven piecing roller is rotated to backfeed the yarn into the yarn draw-off tube.

7. An apparatus for piecing of a yarn at a spinning device of an open-end spinning device; comprising a traveling service carriage configured to travel alongside individual spinning devices of said open-end spinning machine to conduct piecing operations at said individual spinning stations;

a yarn suction tube movably mounted on said service carriage and movable to a position relative to said spinning device from said service carriage to suck a yarn end at the spinning device into the suction tube;

a yarn presentation device movably mounted on said service carriage and movable to take the yarn from said suction tube and deliver the yarn to a yarn preparation device mounted on the service carriage wherein the yarn end is held and prepared for piecing;

a movable bearing device mounted on said service carriage and movable from a first work position relative to said service carriage to a second work position closer to said spinning device; and a plurality of handling elements mounted on said bearing device wherein in a joint motion phase of said handling elements as or after said bearing device is moved from said first work position to said second work position, a first said handling element pulls the yarn end out of said yarn preparation device and presents the yarn to a yarn draw-off tube of said spinning device, a second said handling element comprising a driven piecing roller is brought to bear against a non-driven roller of said spinning device for backfeeding the yarn into said yarn draw-off tube, and a third said handling element comprising an actuating lever is brought to bear against a pressure roller of said spinning device.

8. The apparatus as in claim 7, wherein said first handling element comprises a feed device rigidly mounted on said bearing device and having a length so as to extend beyond said bearing device and present the yarn end to said yarn draw-off tube when said bearing device moves to said second work position.

9. The apparatus as in claim 8, wherein said feed device further comprises a pair of rollers mounted at an end thereof for holding the yarn.

10. The apparatus as in claim 7, further comprising a yarn reserve hoop handling element movably mounted on said bearing device, said yarn reserve hoop handling element movable from said first work position of said bearing device to engage the yarn after the yarn is held by said preparation device after the yarn end is held by the preparation device and as the bearing device to bring the yarn to a required yarn length for piecing, said yarn reserve hoop handling element movable with said bearing device to maintain said required yarn length at said second work position of said bearing device.

11. The apparatus as in claim 10, wherein said bearing device is movable linearly from its said first work position to its said second work position.

12. The apparatus as in claim 11, wherein said bearing device comprises a plate member, said handling elements mounted on either side of said plate member.

* * * * *